US006626366B2

(12) United States Patent
Kayahara et al.

(10) Patent No.: US 6,626,366 B2
(45) Date of Patent: Sep. 30, 2003

(54) SYSTEM FOR SERVICING AND MAINTAINING HEAT SUPPLY EQUIPMENT

(75) Inventors: Toshihiro Kayahara, Matsuyama (JP); Kazuhiro Tachino, Matsuyama (JP); Yasuo Watanabe, Hojo (JP)

(73) Assignee: Miura Co., Ltd., Ehime-ken (JP)

( * ) Notice: Subject to any disclaimer, the term of this patent is extended or adjusted under 35 U.S.C. 154(b) by 168 days.

(21) Appl. No.: 09/950,681

(22) Filed: Sep. 13, 2001

(65) Prior Publication Data

US 2002/0030114 A1 Mar. 14, 2002

(30) Foreign Application Priority Data

Sep. 13, 2000 (JP) ..... 2000-278405

(51) Int. Cl.[7] ..... F25B 49/02

(52) U.S. Cl. ..... 236/94; 236/51; 62/126; 165/11.2

(58) Field of Search ..... 62/125, 126, 127, 62/129, 130, 131; 236/51, 94; 340/584, 585, 586, 587, 588, 589; 700/276, 277, 278; 165/11.1, 11.2

(56) References Cited

U.S. PATENT DOCUMENTS 5,446,677 A * 8/1995 Jensen et al. ..... 62/126 X
5,586,446 A * 12/1996 Torimitsu ..... 62/126
5,682,329 A * 10/1997 Seem et al. ..... 700/276
6,502,409 B1 * 1/2003 Gatling et al. ..... 236/51 X

* cited by examiner

*Primary Examiner*—Harry B. Tanner
(74) *Attorney, Agent, or Firm*—Birch, Stewart, Kolasch & Birch, LLP

(57) ABSTRACT

There is provided a system for servicing and maintaining heat supply equipment which ensures reliable analysis and high efficiency. Heat supply equipment 1 is composed of a control unit 5 to be attached to the heat supply equipment 1, and an equipment-side modem 6 for mediating the control unit 5 and a communication line 4. A management station 3 is composed of a management unit 7 for managing the heat supply equipment 1, and a station-side modem 8 for mediating the management unit 7 and the communication line 4. Upon reception of abnormality occurrence data sent from the control unit 5, the management unit 7 further receives detailed information data on an abnormality of the heat supply equipment 1 from the control unit 5, analyses by itself the received detailed information data, and creates recovery data for recovering the heat supply equipment 1 from the abnormality.

7 Claims, 8 Drawing Sheets

SYSTEM FOR SERVICING AND MAINTAINING HEAT SUPPLY EQUIPMENT

BACKGROUND OF THE INVENTION

The present invention relates to a system for servicing and maintaining heat supply equipment such as boilers through use of communication lines, and more particularly relates to a system for servicing and maintaining heat supply equipment, which is established at least between one or more equipment sites that conclude a servicing and maintenance contract and a management station for maintaining and managing heat supply equipment in the area that the equipment sites are located.

In recent years, with development of electronic techniques and communication techniques, automatic control of heat supply equipment is implemented by a servicing and maintenance system incorporating micro computers and modems therein and using communication lines. More particularly, the heat supply equipment is equipped with various sensors that detect operating states of the heat supply equipment, as well as with a control unit that selects operating conditions of the heat supply equipment based on signals from these various sensors. A management unit of a remote management station and the control unit of the heat supply equipment are connected to a communication line through a modem that performs automatic transmittance and reception of data. This enables the heat supply equipment to report the operating states thereof to the management station in real time, and enables the management station to perform servicing and management based on the reported operating states.

The heat supply equipment is serviced and maintained by the above-stated servicing and maintenance system. Accordingly, if abnormal stop of the heat supply equipment occurs, the abnormal stop is reported to the management unit of the remote management station through a communication line. In the management station, upon reception of the report on the abnormal stop, a data analyst collects information on the reported abnormal stop through use of the management unit, analyzes the cause thereof, and sends recovery information based on an analysis result to an equipment site on which the heat supply equipment is installed. In some cases, the management station dispatches a maintenance man to the equipment site and performs maintenance service such as repair works where necessary.

In the above described prior art, however, there has been a danger that the analysis result would depend on the level of skill regarding cause analysis of the data analyst (because the analysis result includes determination of the data analyst). There has also been a danger that the skill level of the data analyst could disturb prompt measurement to be taken.

SUMMARY OF THE INVENTION

Accordingly, the present invention is to be made with consideration of the above-described circumstances, and an object thereof is to provide a system for servicing and maintaining heat supply equipment, which ensures reliable analysis and high efficiency.

In order to accomplish the above object, a system for servicing and maintaining heat supply equipment according to a first aspect of the present invention has the following basic structure as shown in FIG. 1. The system for servicing and maintaining heat supply equipment is established at least between one or more equipment sites 2 that have heat supply equipment 1 and conclude a servicing and maintenance contract regarding the heat supply equipment 1, and a management station 3 that performs servicing and maintenance of the heat supply equipment 1 in an area in which the equipment sites 2 are located, the system being established through use of a communication line 4, the heat supply equipment 1 comprising: a control unit 5 to be attached to the heat supply equipment 1; and an equipment-side modem 6 for mediating the control unit 5 and the communication line 4, the management station 3 comprising: a management unit 7 for managing the heat supply equipment 1; and a station-side modem 8 for mediating the management unit 7 and the communication line 4, wherein upon reception of abnormality occurrence data sent from the control unit 5, the management unit 7 further receives detailed information data on an abnormality of the heat supply equipment 1 from the control unit 5, analyses by itself the received detailed information data, and creates recovery data for recovering the heat supply equipment 1 from the abnormality.

According to a second aspect of the present invention, there is provided the system for servicing and maintaining heat supply equipment as defined in the first aspect of the present invention, wherein the recovery data is data regarding recovery instruction information for instructing procedures of recovering the heat supply equipment 1, and the control unit 5, upon reception of the recovery data regarding the recovery instruction information from the management unit 7, displays the recovery instruction information based on the recovery data on a display section 9 provided in the control unit 5.

According to a third aspect of the present invention, there is provided the system for servicing and maintaining heat supply equipment as defined in the first aspect of the present invention, wherein the recovery data is data regarding recovery instruction information for instructing procedures of recovering the heat supply equipment 1, and the management unit 7 sends the recovery data regarding the recovery instruction information to a portable terminal 12 carried by a maintenance man 11 by wireless communication means 10.

According to a fourth aspect of the present invention, there is provided the system for servicing and maintaining heat supply equipment as defined in the third aspect of the present invention, wherein the management unit 7 collects location information transmitted by the portable terminal 12 and determines the maintenance man 11 who can recover the heat supply equipment 1 fastest.

According to a fifth aspect of the present invention, there is provided the system for servicing and maintaining heat supply equipment as defined in the first aspect of the present invention, wherein the recovery data is data regarding change in setting values and the like of the heat supply equipment 1, and the control unit 5, upon reception of the recovery data regarding the change in setting values and the like, changes setting values and the like of the heat supply equipment 1 based on the recovery data.

According to a sixth aspect of the present invention, there is provided the system for servicing and maintaining heat supply equipment as defined in the first aspect of the present invention, wherein the management unit 7 stores readable data on a maintenance manual.

According to a seventh aspect of the present invention, there is provided the system for servicing and maintaining heat supply equipment as defined in the first aspect of the present invention, wherein the management unit 7 has a function to transfer the received abnormality occurrence data to a management center supervising a plurality of management stations including the management station 3 through the communication line 4.

According to the first aspect of the present invention, when an abnormality occurs in the heat supply equipment 1, the management unit 7 automatically analyzes detailed information data sent from the control unit 5, and creates recovery data for recovering the heat supply equipment 1 from the abnormality.

According to the second aspect of the present invention, the control unit 5 receives data regarding recovery instruction information for instructing procedures of recovering the heat supply equipment 1, and displays the data on the display section 9. The display section 9 displays the recovery instruction information for instructing the procedures of recovering the heat supply equipment 1.

According to the third aspect of the present invention, the management unit 7 sends data regarding recovery instruction information for instructing procedures of recovering the heat supply equipment 1 to the portable terminal 12 carried by the maintenance man 11 by the wireless communication means 10. Thus, the maintenance man 11 can obtain the recovery instruction information for instructing the procedures of recovering the heat supply equipment 1 through the portable terminal 12.

According to the fourth aspect of the present invention, when sending data regarding recovery instruction information for instructing procedures of recovering the heat supply equipment 1 to the portable terminal 12, the management unit 7 collects location information transmitted by the portable terminal 12 and determines the maintenance man 11 who can recover the heat supply equipment 1 fastest.

According to the fifth aspect of the present invention, upon reception of data regarding change in setting values and the like of the heat supply equipment 1, the control unit 5 changes the setting values and the like of the heat supply equipment 1 based on the received data. This function is implemented in the case where the heat supply equipment 1 can be recovered from the abnormality by changing the setting values and the like.

According to the sixth aspect of the present invention, the management unit 7 stores readable data on a maintenance manual. If the maintenance man 11 needs the maintenance manual in performing maintenance service, the maintenance man 11 can read the data by connecting the portable terminal 12 to the control unit 5 and the like.

According to the seventh aspect of the present invention, the management unit 7 transfers received abnormality occurrence data to a management center supervising a plurality of management stations including the management station 3 through the communication line 4 where needed.

BRIEF DESCRIPTION OF THE DRAWINGS

FIG. 5 is a schematic view showing a flow of recovery operation based on data regarding change in setting values and the like;

DETAILED DESCRIPTION OF THE PREFERRED EMBODIMENTS

The embodiments of the present invention will be described hereinafter with reference to the drawings.

Figure 1:
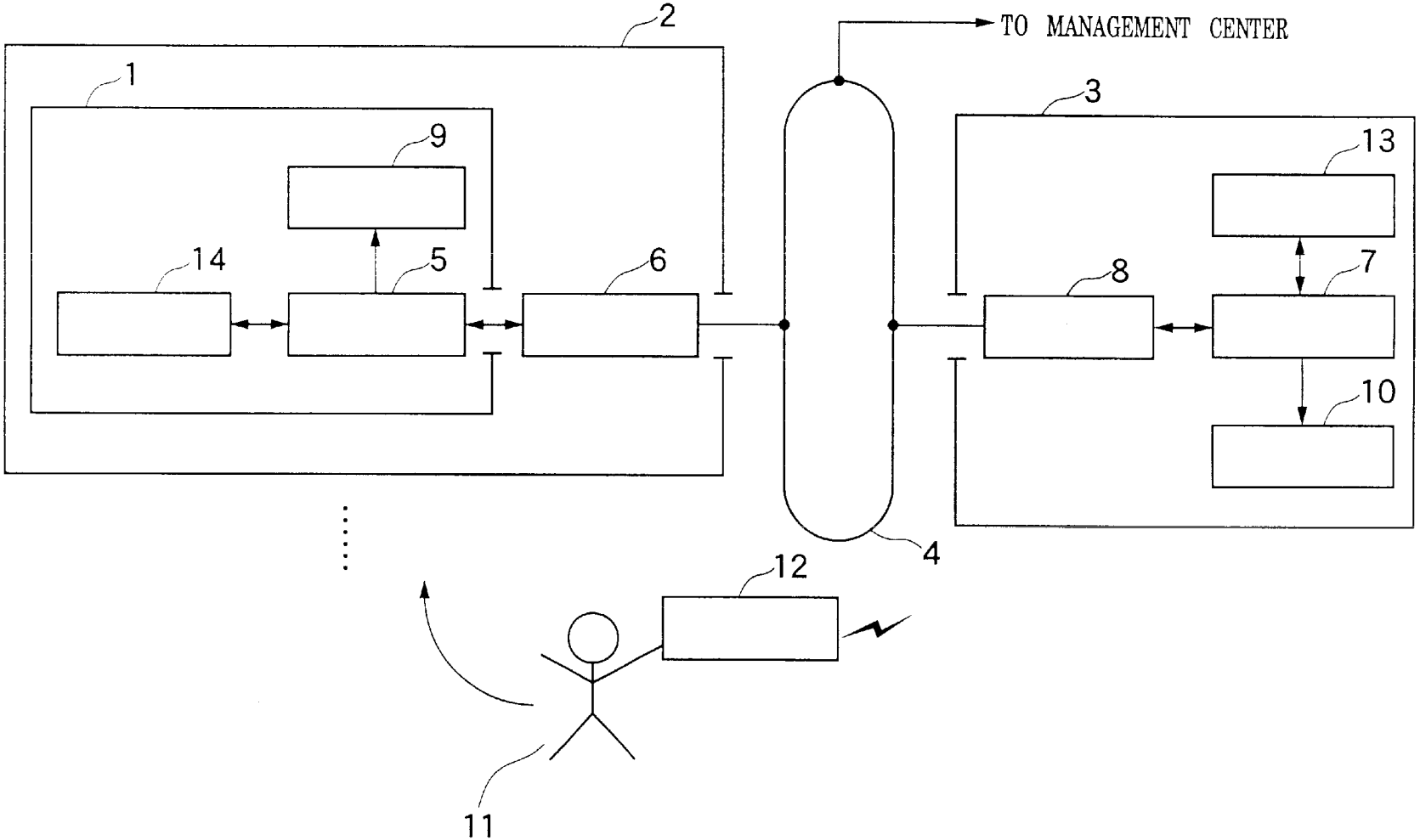
FIG. 1 is a view showing the basic configuration of a system for servicing and maintaining heat supply equipment of the present invention.
Figure 2:
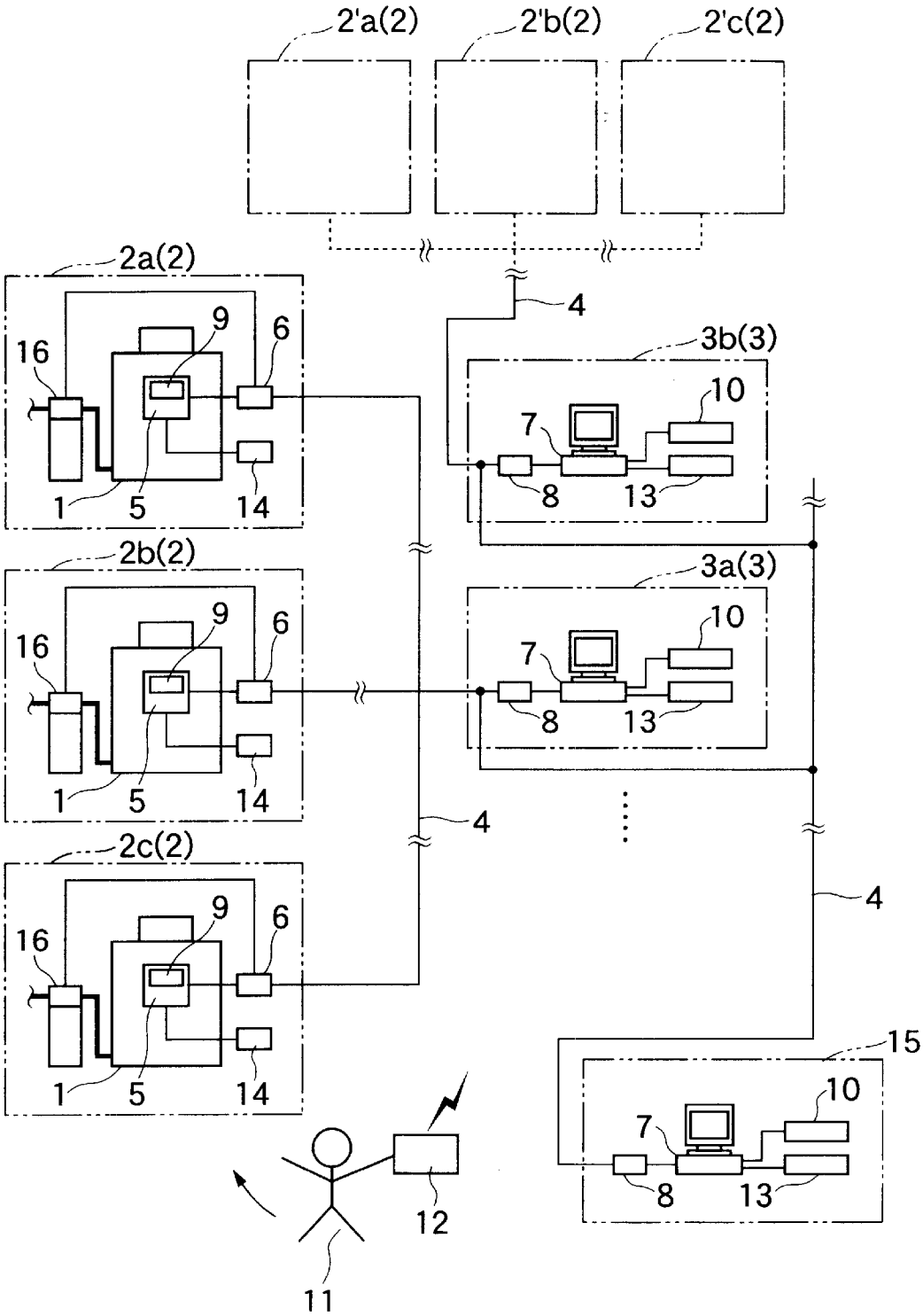
FIG. 2 is a configuration diagram showing a system for servicing and maintaining heat supply equipment according to one aspect of the present invention.
Figure 3:
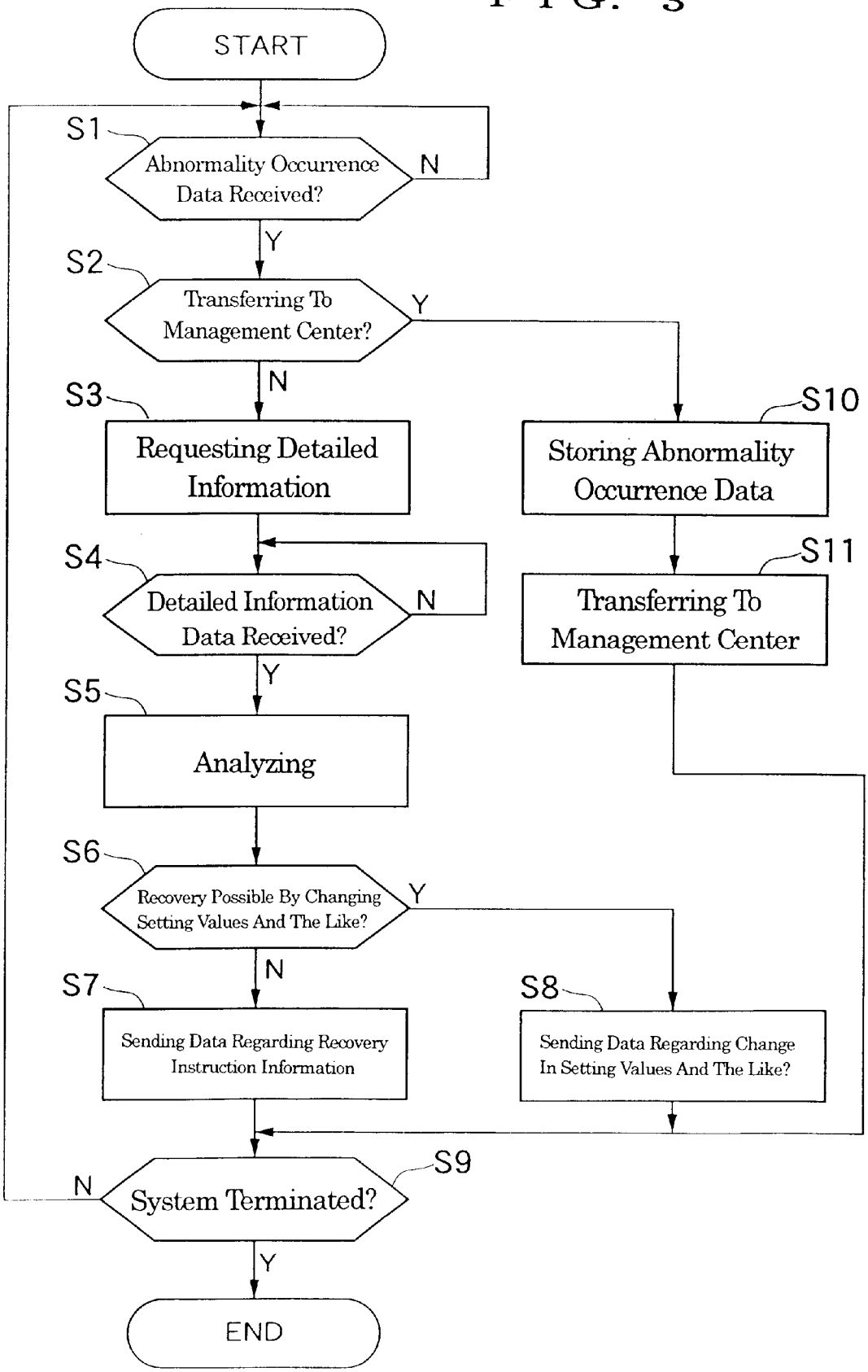
FIG. 3 is a flow chart showing operation of a management unit.

FIG. 2 is a configuration diagram showing a system for servicing and maintaining heat supply equipment according to one aspect of the present invention, and FIG. 3 is a flow chart showing operation of a management unit.

As shown in FIG. 2, the system for servicing and maintaining heat supply equipment in the present invention is established, in a narrow sense, between a plurality of (or a singular) equipment sites 2*a,* 2*b* and 2*c,* and a management station 3*a* in an area in which a plurality of the equipment sites 2*a,* 2*b* and 2*c* are located through use of a communication line 4. In a broad sense, the system is established among a plurality of the equipment sites 2*a,* 2*b* and 2*c,* the management station 3*a,* a plurality of (or a singular) equipment sites 2'*a,* 2'*b* and 2'*c,* a management station 3*b* in an area in which a plurality of the equipment sites 2'*a,* 2'*b* and 2'*c* are located, other unshown equipment sites and management stations, and a management center 15 supervising these management stations through use of the communication line 4.

The equipment sites 2*a,* 2*b* and 2*c* are each provided with heat supply equipment 1 (same as the case of the equipment sites 2'*a,* . . . ). The management stations 3*a,* 3*b,* . . . and the management center 15 are each provided with a management unit 7 and a modem 8 connected to the communication line 4. It is noted that the equipment site is expressed by reference numeral 2*a,* . . . , and in collective means expressed by reference numeral 2. It is also noted that the management station is expressed by reference numeral 3 in collective means. It will be understood that the system for servicing and maintaining heat supply equipment of the present invention is established based on a servicing and maintenance contract concluded regarding the heat supply equipment 1.

Brief description will be herein given of the servicing and maintenance contract. The servicing and maintenance contract defines performance maintenance, function maintenance, and abnormal recovery for the units of the heat supply equipment 1. More particularly, the contract defines that the performance of the units shall be maintained in a good condition (high efficiency condition), the intended function of the units shall be maintained by preventing halt of the units due to occurrence of abnormalities, and the units shall be promptly recovered to a normal state if abnormalities of the units should occur. For implementing the performance maintenance and function maintenance, a periodic inspection shall be conducted, for example, every four (4) months as a preventive maintenance.

Hereinbelow, detailed description will be given of the configuration of the above-stated each unit, and description will then given of the operation of the system for servicing and maintaining heat supply equipment of the present invention.

The heat supply equipment 1 includes for example an once-through steam boiler and boiler-related equipment. The once-through steam boiler is equipped with a control unit 5 having various sensors and with a modem 6 connected to the communication line 4. The boiler-related equipment is equipped with a control unit 16 same as the control unit 5. The control unit 5 is provided with a display section 9 and an interface 14. The control unit 5 and the control unit 16 are connected to the modem 6 through a dedicated line. The heat supply equipment 1 is automatically controlled by the control unit 5 and the like.

The control unit 5 and the control unit 16 are each configured to incorporate an unshown ROM, CPU, EEPROM, RAM and the like. The ROM is a read only memory, storing programs and fixed data. The CPU is a central processing unit operated in accordance with a control program prestored in the ROM. The EEPROM is an electrically erasable and programmable read only memory, storing various setting information and the like. The RAM is a random access memory, having such area as a data area for storing various data for use in the CPU processing, and a work area for use in processing. It is noted that the CPU creates data such as abnormality occurrence data and detailed information data to be transmitted to the management unit 7 when an abnormality of the heat supply equipment 1 is detected. It is also noted that ports for external load are connected to the control unit and above-stated various sensors.

The abnormality occurrence data includes abnormality data and prognostic data. The abnormality data is to inform halt of the heat supply equipment 1 due to actual occurrence of an abnormality. For example, ignition failure and water level decrease are included in this data. The prognostic data is to inform that immediate halt of the heat supply equipment 1 is not necessary but it is highly probable that abnormalities will occur and the heat supply equipment 1 will halt in a few days. For example, decreased performance of feedwater pump is included in this data (decreased performance of a feedwater pump induces water level decrease).

The display section 9 is the so-called monitor, which displays the operating state of the heat supply equipment 1, as well as recovery instruction information for instructing procedures of recovery in occurrence of an abnormality and the like. The interface 14 is a connecting section mainly used for readout of data, and a later-described portable terminal 12 is connected thereto (an equivalence of the interface 14 may be attached to the control unit 16).

The management unit 7 is exemplified by a personal portable computer (including a monitor) configured so as to manage the heat supply equipment 1. The management unit 7 is configured, like the control unit 5, to incorporate an unshown ROM, CPU, EEPROM, RAM and the like (the EEPROM stores a maintenance manual and confirmation procedures for abnormality recovery (recovery instruction information)). Further, the management unit 7 is provided with an interface 13 and a wireless communication means 10 such as radios. The interface 13 is a connecting section mainly used for readout of data, and a later-described portable terminal 12 is connected thereto. It is noted that the wireless communication means 10 uses a digital portable telephone network. It is also noted that data transfer to the later-described portable terminal 12 is available.

Reference numeral 11 denotes a maintenance man who belongs to the management station 3 (one or more maintenance men are present). The maintenance man 11 carries the portable terminal 12 with him. The maintenance man 11 goes to, for example, an equipment site 2 where an abnormality has occurred, with the portable terminal 12, and performs maintenance service there. The portable terminal 12 is, for example, a notebook-sized personal portable computer. It is noted that the portable terminal 12 can receive after-mentioned data regarding recovery instruction information. It is also noted that the portable terminal 12 can send data regarding position information to the management unit 7. The portable terminal 12 is preferably configured to have a function of, for example, PHS (Personal Handy Phone System).

Description will be given of an outline of the operation executed by the unshown CPU of the management unit 7 with reference to the flow chart of FIG. 3. (Description will be given of an outline of the operation in the occurrence of abnormalities. Description of normal operating management will be omitted). FIG. 2 is also referred where necessary.

In a step S1, it is determined if abnormality occurrence data sent from the control unit 5 is received or not. If the abnormality occurrence data is not received (N in the step S1), the system waits for reception of the abnormality occurrence data. If the abnormality occurrence data is received (Y in the step S1), the processing flow moves to a step S2. Once the processing flow is moved to the step S2, it is determined if the received abnormality occurrence data should be transferred to the management center 15 or not. If transfer is not necessary (N in the step S2), the processing flow moves to a step S3. Once the processing flow moves to the step S3, there is executed in the step S3 processing of requesting detailed information on the abnormality of the heat supply equipment 1 from the control unit 5. Upon execution of the processing of the step S3, the processing flow moves to a step S4.

Once the processing flow moves to the step S4, it is determined if detailed information data sent from the control unit 5 is received or not. If the detailed information data is not received (N in the step S4), the system waits for reception of the detailed information data. If the detailed information data is received (Y in the step S4), the processing flow moves to a step S5. Once the processing flow moves to the step S5, there is executed processing of analyzing the received detailed information data. (The CPU automatically analyses the data. The CPU creates after-mentioned recovery data based on, for example, typified causes of abnormalities.) Upon execution of the processing of the step S5, the processing flow moves to a step S6.

Once the processing flow moves to the step S6, it is determined based on the analysis result if recovery of the heat supply equipment 1 is possible by changing setting values and the like or not. If the recovery is not possible by changing the setting values and the like (N in the step S6), the processing flow moves to a step S7. Once the processing flow moves to the step S7, there is created data regarding recovery instruction information for instructing procedures of recovering the heat supply equipment 1 (recovery data), and there is executed processing of sending the created recovery data to the control unit 5. (Here, the created recovery data is also sent to the maintenance man 11 who can arrive at the heat supply equipment 1 with an abnormality in the shortest period of time. The management unit 7 collects data regarding the location information, and determines the maintenance man 11 who performs maintenance service.) If the recovery is possible by changing the setting values and the like (Y in the step S6), the processing flow moves to a step S8. Once the processing flow moves to the step S8, there is created data regarding change in the setting values and the like of the heat supply equipment 1

(recovery data), and there is executed processing of sending the created recovery data to the control unit 5. Upon execution of the processing of the step S7 or S8, the processing flow moves to a step S9. In the step S9, if the system is terminated (Y in the step S9), a series of processing ends. If not (N in the step S9), the processing flow returns to the step S1, and it is determined, for example, if abnormality occurrence data from other heat supply equipment 1 is received or not.

If it is necessary to transfer the abnormality occurrence data received in the step S2 to the management center 15 (Y in the step S2, such as the case of the absence of the management station 3), the received abnormality occurrence data is stored in a step S10, and then the received abnormality occurrence data is transferred to the management center 15 in a step S11. After that, the processing flow moves to the step S9.

As is clear from the outline of the operation described above, analysis regarding abnormalities of the heat supply equipment 1 is performed not by a data analyst but by the management unit 7 itself, which enables efficient analyzing operation. This ensures reliable analysis and recovery regardless of the level of skill.

Figure 4:
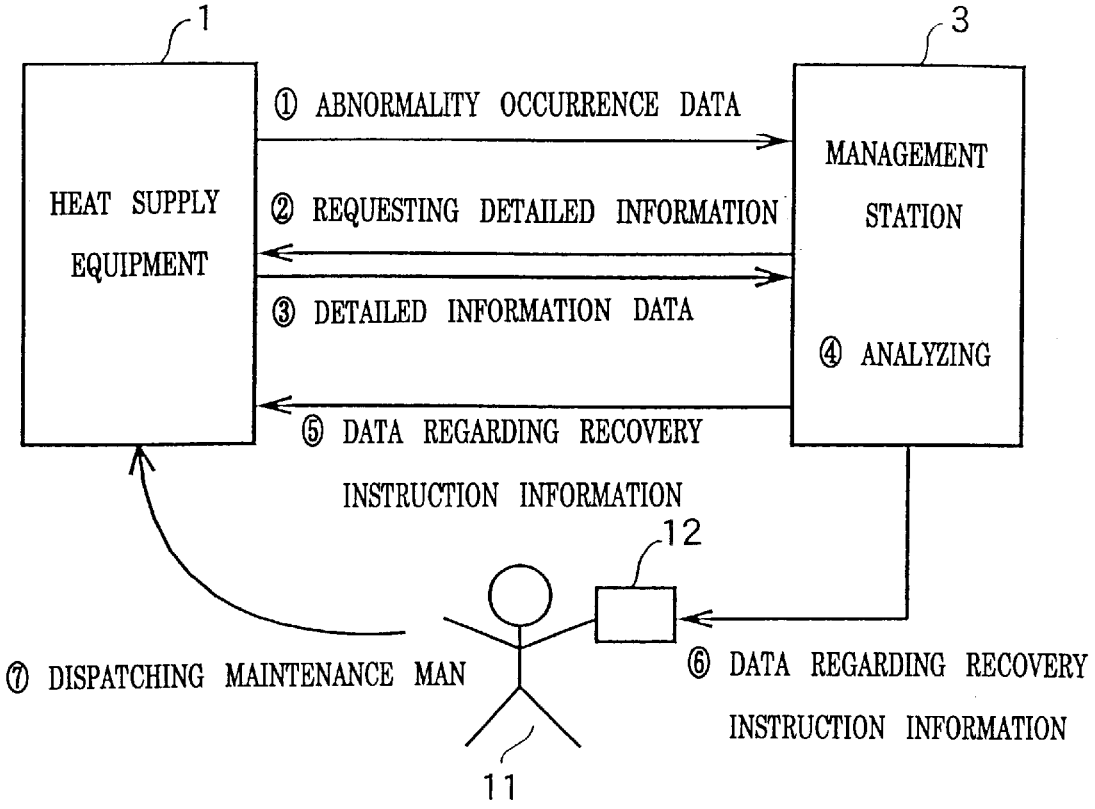
FIG. 4 is a schematic view showing a flow of recovery operation based on data regarding recovery instruction information.
Figure 5:
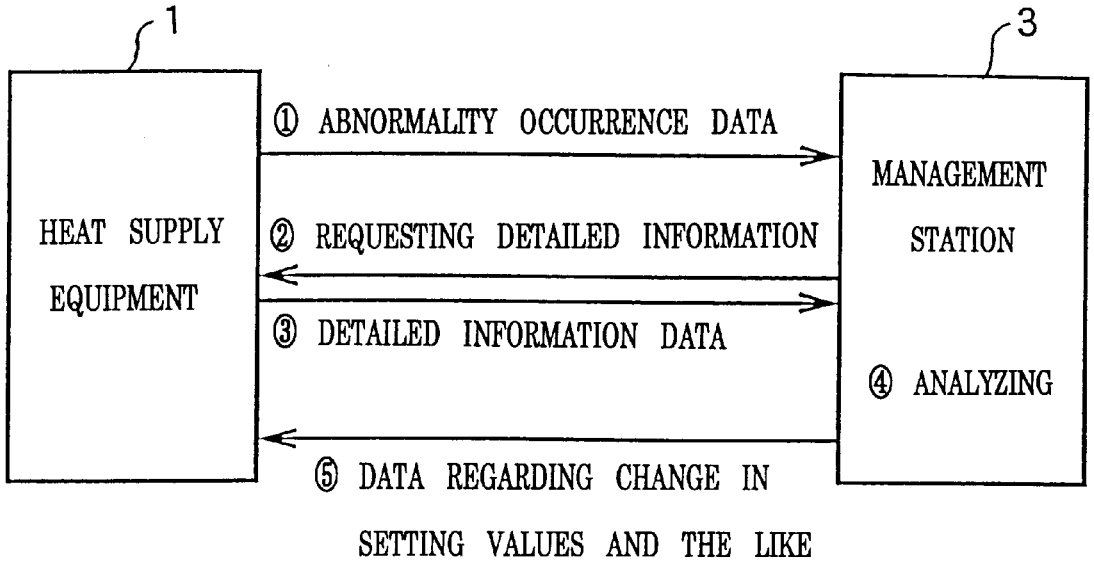
Figure 6:
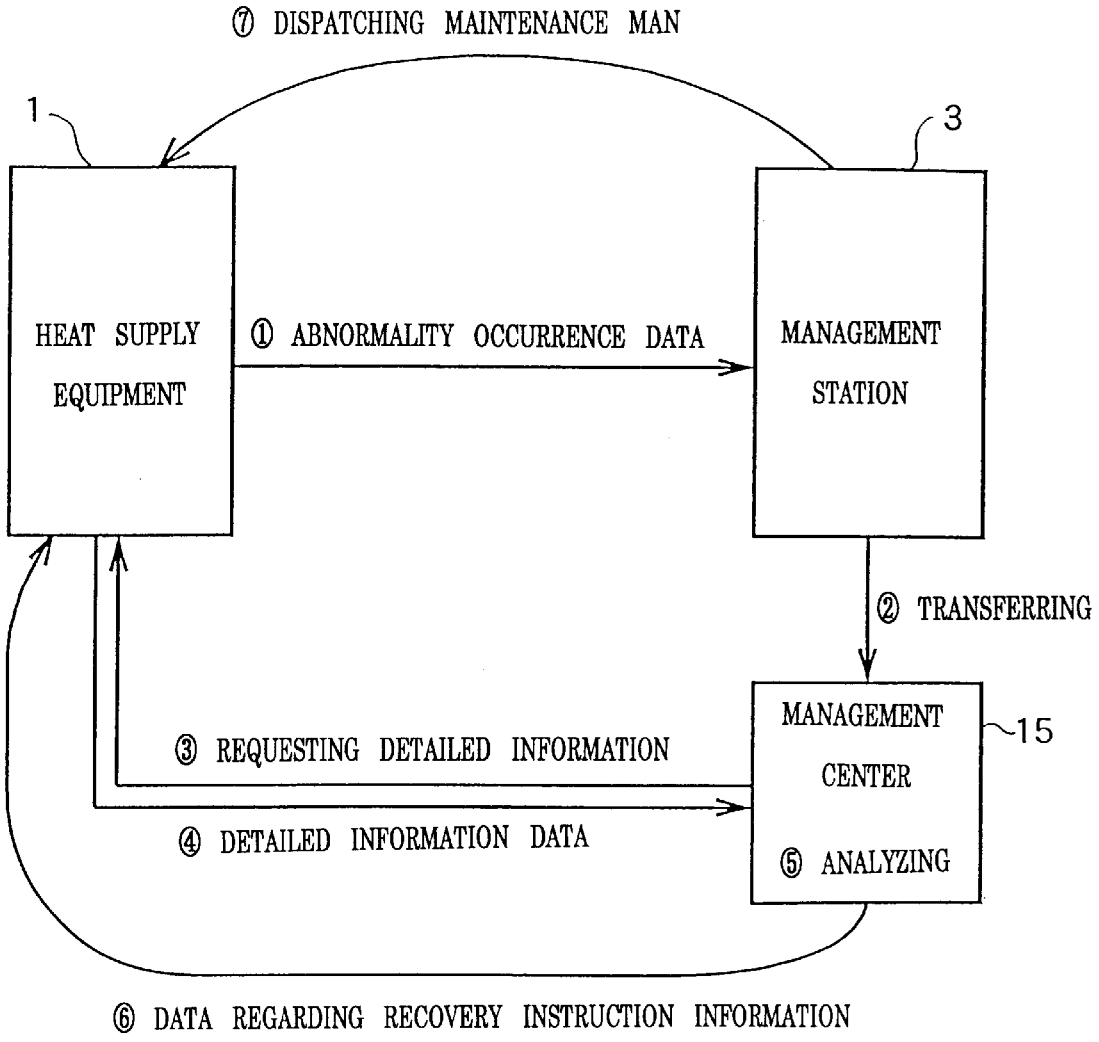
FIG. 6 is a schematic view showing a flow of recovery operation (including transfer to a management center) based on data regarding recovery instruction information.
Figure 7:
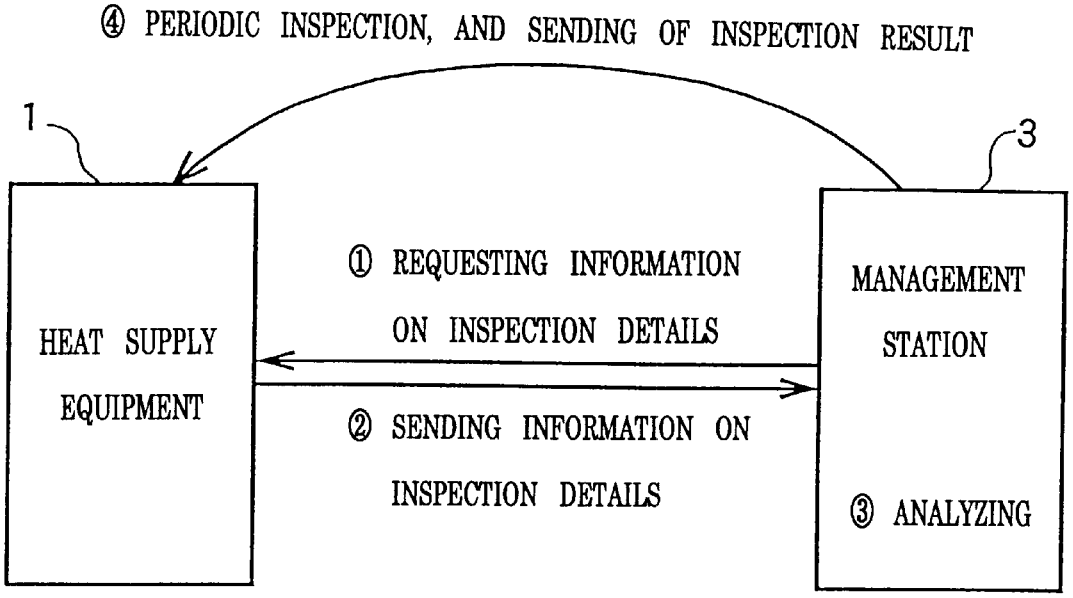
FIG. 7 is a schematic view showing a flow of sending the result of a periodical inspection.
Figure 8:
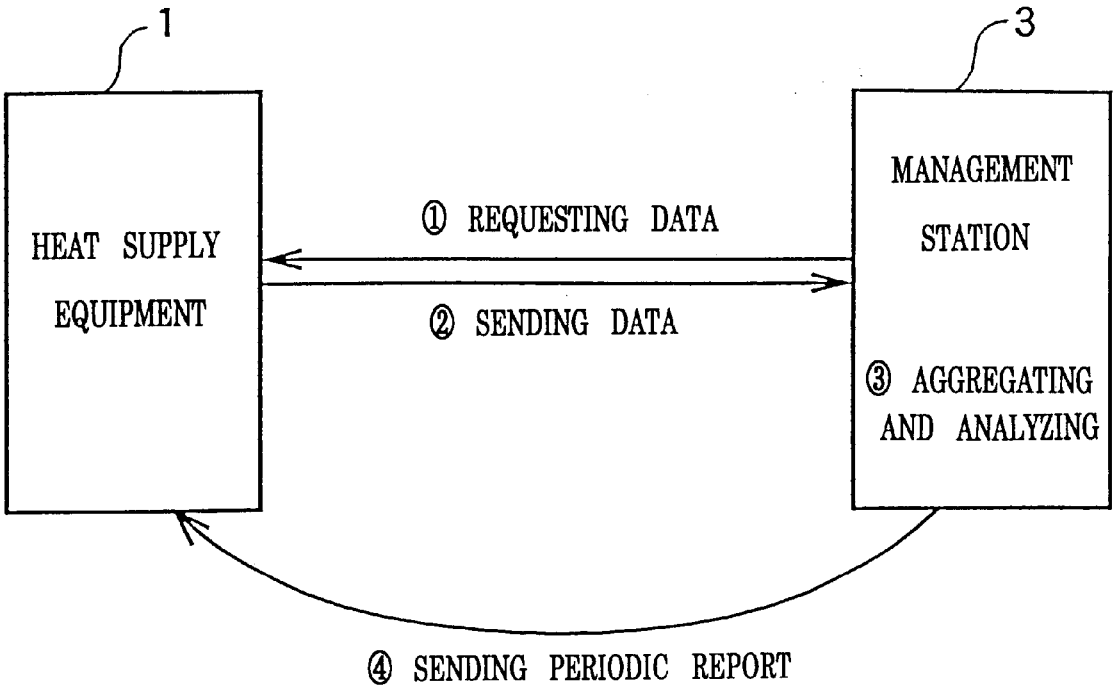
FIG. 8 is a schematic view showing a flow of sending a periodical report.

Description will be now given of the operation of the system for servicing and maintaining heat supply equipment according to the present invention with reference to FIGS. 4 to 8 in order. FIG. 4 is a schematic view showing a flow of recovery operation based on data regarding recovery instruction information, FIG. 5 is a schematic view showing a flow of recovery operation based on data regarding change in setting values and the like, FIG. 6 is a schematic view showing a flow of recovery operation (including transfer to a management center) based on data regarding recovery instruction information, FIG. 7 is a schematic view showing a flow of sending the result of a periodical inspection, and FIG. 8 is a schematic view showing a flow of sending a periodical report.

(Operation 1 in the Occurrence of Abnormalities)

In FIG. 4, when an abnormality of the heat supply equipment 1 occurs, the heat supply equipment 1 first sends abnormality occurrence data to the management station 3 (refer to ① in the figure). Next, upon reception of the abnormality occurrence data, the management station 3 requests detailed information on the abnormality from the heat supply equipment 1 (refer to ② in the figure). The heat supply equipment 1 then sends the detailed information data to the management station 3 (refer to ③ in the figure). Upon reception of the detailed information data, the management station 3 automatically analyzes the detailed information data (refer to ④ in the figure) to create data regarding the recovery instruction information (recovery data), and sends the created recovery data to the heat supply equipment 1 (refer to ⑤ in the figure). At this point, the management station 3 also sends the recovery data to the portable terminal 12 carried by the maintenance man 11 (refer to ⑥ in the figure). If a person in charge of managing the heat supply equipment 1 cannot make recovery with use of the recovery data sent to the heat supply equipment 1, the maintenance man 11 is dispatched to implement recovery (refer to ⑦ in the figure).

In the case where the maintenance man 11 is dispatched for recovery, the maintenance man 11 can perform the following actions in addition to maintenance service. By connecting the portable terminal 12 to the interface 14 (see FIG. 2), the maintenance man 11 can read detailed information data with the portable terminal 12. The maintenance man 11 can also see the maintenance manual stored in the management unit 7 (see FIG. 2). (This means that the maintenance man 11 does not have to carry a printed manual with him.)

Once the recovery data is received by the heat supply equipment 1, the display section 9 (see FIG. 2) in the heat supply equipment 1 displays, for example, the following recovery instruction information: "Ignition is failed. Check the following points"; "1. Fuel valve is opened?"; "2. Fuel is in the fuel tank?"; "3. Oil pump is free from air binding?"; and "4. Protection glass of fire detection sensor is clean?".

Operation 2 in the Occurrence of Abnormalities

In FIG. 5, when an abnormality of the heat supply equipment 1 occurs, the heat supply equipment 1 first sends abnormality occurrence data to the management station 3 (refer to ① in the figure). Next, upon reception of the abnormality occurrence data, the management station 3 requests detailed information on the abnormality from the heat supply equipment 1 (refer to ② in the figure). The heat supply equipment 1 then sends the detailed information data to the management station 3 (refer to ③ in the figure). Upon reception of the detailed information data, the management station 3 automatically analyzes the detailed information data (refer to ④ in the figure) to create data regarding change in the setting values and the like (recovery data), and sends the created recovery data to the heat supply equipment 1 (refer to ⑤ in the figure). Upon reception of the recovery data, the heat supply equipment 1 changes the setting values and the like of the heat supply equipment 1 based on the received recovery data.

The change in the setting values and the like are as follows. For example, in the case where water level decrease of the once-through steam boiler occurs from time to time, the detailed information data is analyzed to identify the cause thereof. If it is attributed to concentration of boiler water, a setting blow rate is changed to be larger. If it is attributed to other causes, the timing of on/off control of the feedwater pump is changed so that the position of a water level control range is set to be higher.

(Operation 3 in the Occurrence of Abnormalities)

In FIG. 6, when an abnormality of the heat supply equipment 1 occurs, the heat supply equipment 1 first sends abnormality occurrence data to the management station 3 (refer to ① in the figure). Next, upon reception of the abnormality occurrence data, the management station 3 (assumed that management station 3 be attended by no one due to night time for instance) transfers the received abnormality occurrence data to the management center 15 (refer to ② in the figure). The management center 15 requests detailed information on the abnormality from the heat supply equipment 1 (refer to ③ in the figure). The heat supply equipment 1 then sends the detailed information data to the management center 15 (refer to ④ in the figure). Upon reception of the detailed information data, the management center 15 automatically analyzes the detailed information data (refer to ⑤ in the figure) to create data regarding the recovery instruction information (recovery data), and sends the created recovery data to the heat supply equipment 1 (refer to ⑥ in the figure). If a person in charge of managing the heat supply equipment 1 cannot make recovery with use of the recovery data sent to the heat supply equipment 1, the maintenance man 11 who belongs to the management station 3 is dispatched upon reception of transferred data to implement recovery (refer to ⑦ in the figure). Thought not shown with the drawings, if recovery is possible by changing the setting values and the like of the heat supply equipment 1, data regarding change in the setting values and the like created based on analysis (recovery data) is sent from the management center 15 to the heat supply equipment 1.

Operation 1 Other than the Above Description

In FIG. 7, before conducting a periodic inspection, the management station 3 requests information on inspection details of the heat supply equipment 1 from the heat supply equipment 1 (refer to ① in the figure). Upon reception of the request, the heat supply equipment 1 sends the information on the inspection details to the management station 3 (refer to ② in the figure). Upon reception of the information on the inspection details, the management station 3 automatically analyzes the received information (refer to ③ in the figure). Upon completion of the analysis (or upon sending of the analysis result), the periodic inspection of the heat supply equipment 1 is conducted (refer to ④ in the figure).

Operation 2 Other than the Above Description

In FIG. 8, in times of preparing a periodic report, the management station 3 requests data on the heat supply equipment 1 from the heat supply equipment 1 (refer to ① in the figure). Upon reception of the request, the heat supply equipment 1 sends the data on the heat supply equipment 1 to the management station 3 (refer to ② in the figure). Upon reception of the data on the heat supply equipment 1, the management station 3 automatically aggregates and analyzes the received data (refer to ③ in the figure). The management station 3 then sends the periodic report to the heat supply equipment 1 (refer to ④ in the figure).

As described above, according to the first aspect of the present invention, analysis regarding abnormalities of the heat supply equipment is performed not by a data analyst but by the management unit itself, which enables efficient analyzing operation. This ensures reliable analysis and recovery regardless of the level of skill. Therefore, the system for servicing and maintaining heat supply equipment which ensures reliable analysis and high efficiency can be provided. According to the present invention, a conventional data analyst is not necessary, and therefore, the present invention can contribute to mechanization.

According to the second aspect of the present invention, recovery instruction information for instructing procedures of the heat supply equipment is displayed on the display section provided in the control unit. Consequently, a person in charge of managing the equipment site can perform recovery operation with reference to the displayed recovery instruction information.

According to the third aspect of the present invention, data regarding recovery instruction information for instructing procedures of recovering the heat supply equipment is sent from the management unit to the portable terminal carried by a maintenance man. Consequently, the maintenance man dispatched to the equipment site can implement maintenance service based on the sent recovery instruction information.

According to the fourth aspect of the present invention, the management unit collects position information transmitted by the portable terminals and determines the maintenance man who can recover the heat supply equipment fastest. This ensures efficient and prompt recovery.

According to the fifth aspect of the present invention, the heat supply equipment can be recovered with use of data regarding change in the setting values and the like of the heat supply equipment sent from the management unit.

According to the sixth aspect of the present invention, if a maintenance man needs a maintenance manual in performing maintenance service, the maintenance man can read the data by connecting the portable terminal to the control unit and the like.

According to the seventh aspect of the present invention, the management unit of a management station, which has received abnormality occurrence data, can transfer the abnormality occurrence data to the management center through the communication line. In other words, analysis by the management center is available where necessary.

What is claimed is:

1. A system for servicing and maintaining heat supply equipment, established at least between one or more equipment sites that have heat supply equipment and conclude a servicing and maintenance contract regarding the heat supply equipment, and a management station that performs servicing and maintenance of the heat supply equipment in an area in which the equipment sites are located, the system being established through use of a communication line, the heat supply equipment comprising: a control unit to be attached to the heat supply equipment; and an equipment-side modem for mediating the control unit and the communication line, the management station comprising: a management unit for managing the heat supply equipment; and a station-side modem for mediating the management unit and the communication line, wherein upon reception of abnormality occurrence data sent from the control unit, the management unit further receives detailed information data on an abnormality of the heat supply equipment from the control unit, analyses by itself the received detailed information data, and creates recovery data for recovering the heat supply equipment from the abnormality.

2. The system for servicing and maintaining heat supply equipment as defined in claim 1, wherein the recovery data is data regarding recovery instruction information for instructing procedures of recovering the heat supply equipment, and the control unit, upon reception of the recovery data regarding the recovery instruction information from the management unit, displays the recovery instruction information based on the recovery data on a display section provided in the control unit.

3. The system for servicing and maintaining heat supply equipment as defined in claim 1, wherein the recovery data is data regarding recovery instruction information for instructing procedures of recovering the heat supply equipment, and the management unit sends the recovery data regarding the recovery instruction information to a portable terminal carried by a maintenance man by wireless communication means.

4. The system for servicing and maintaining heat supply equipment as defined in claim 3, wherein the management unit collects location information transmitted by the portable terminal and determines the maintenance man who can recover the heat supply equipment fastest.

5. The system for servicing and maintaining heat supply equipment as defined in claim 1, wherein the recovery data is data regarding change in setting values and the like of the heat supply equipment, and the control unit, upon reception of the recovery data regarding the change in setting values and the like, changes setting values and the like of the heat supply equipment based on the recovery data.

6. The system for servicing and maintaining heat supply equipment as defined in claim 1, wherein the management unit stores readable data on a maintenance manual.

7. The system for servicing and maintaining heat supply equipment as defined in claim 1, wherein the management unit has a function to transfer the received abnormality occurrence data to a management center supervising a plurality of management stations including the management station through the communication line.

* * * * *